US005463779A

United States Patent [19]

Pinkus

[11] Patent Number: 5,463,779

[45] Date of Patent: Nov. 7, 1995

[54] MULTIPLE PLY TIE INTERLINING AND METHOD

[75] Inventor: Fred J. Pinkus, Yardley, Pa.

[73] Assignee: Crown Textile Company, Blue Bell, Pa.

[21] Appl. No.: 814,396

[22] Filed: Dec. 26, 1991

[51] Int. Cl.[6] ..... A41D 25/00

[52] U.S. Cl. ..... 2/144; 2/146; 2/153; 2/272; 112/440; 112/117; 112/475.09

[58] Field of Search ..... 2/144, 146, 153, 2/272; 112/262.2, 440, 117

[56] References Cited

U.S. PATENT DOCUMENTS

| | | | |
|---|---|---|---|
| 1,109,858 | 9/1914 | Mills, Jr. | 2/146 |
| 1,273,261 | 7/1918 | Mills, Jr. | 2/146 |
| 1,337,993 | 4/1920 | Bird | 112/262.1 X |
| 1,421,131 | 6/1922 | Abrams | 112/262.1 X |
| 1,436,134 | 11/1922 | Worms | 2/144 |
| 1,752,914 | 4/1930 | Liebe | 112/262 |
| 1,842,920 | 1/1932 | Simson | 2/146 |
| 2,126,835 | 8/1938 | Steinberger | 2/146 |
| 2,402,795 | 6/1946 | Wipper et al. | 2/146 |
| 2,437,974 | 3/1948 | Schwartz | 112/262.1 X |
| 2,656,543 | 10/1953 | Cohan | 2/146 |
| 3,426,360 | 2/1969 | Ackerman | 2/146 |
| 3,562,814 | 2/1971 | Ackerman | 2/146 |
| 3,657,743 | 4/1972 | Bucci | 2/146 |
| 4,123,802 | 11/1978 | Ackerman | 2/144 |
| 4,192,241 | 3/1980 | Reed et al. | 112/117 |
| 4,229,834 | 10/1980 | Alexander | 2/146 |
| 4,694,509 | 9/1987 | Grubman | 2/144 |

FOREIGN PATENT DOCUMENTS

| | | | |
|---|---|---|---|
| 306724 | 3/1989 | European Pat. Off. | 2/144 |
| 2143599 | 3/1972 | Germany | 2/144 |
| 2156395 | 5/1973 | Germany | 2/144 |
| 2843826 | 4/1980 | Germany | 2/144 |
| 2018573 | 10/1979 | United Kingdom | 2/144 |

*Primary Examiner*—C. D. Crowder
*Assistant Examiner*—Gloria Hale
*Attorney, Agent, or Firm*—Robert C. Podwil; Reed Smith Shaw & McClay

[57] ABSTRACT

An interlining of multiple plies the plies of which may be dissimilar, is made by joining fabric from respective rolls, gathering the stitched-together fabric as roll goods, and die cutting the stitched-together fabric from the roll goods before sewing the interlinings into neckwear.

16 Claims, 1 Drawing Sheet

FIG. 1
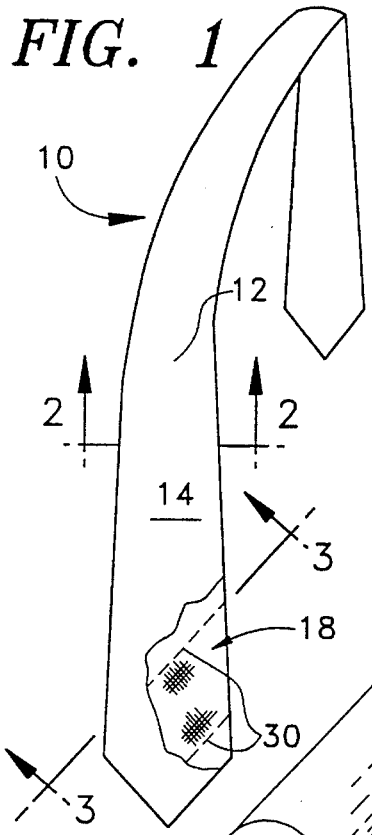
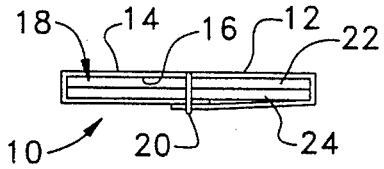
FIG. 2
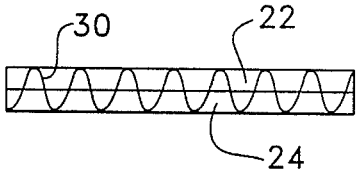
FIG. 3
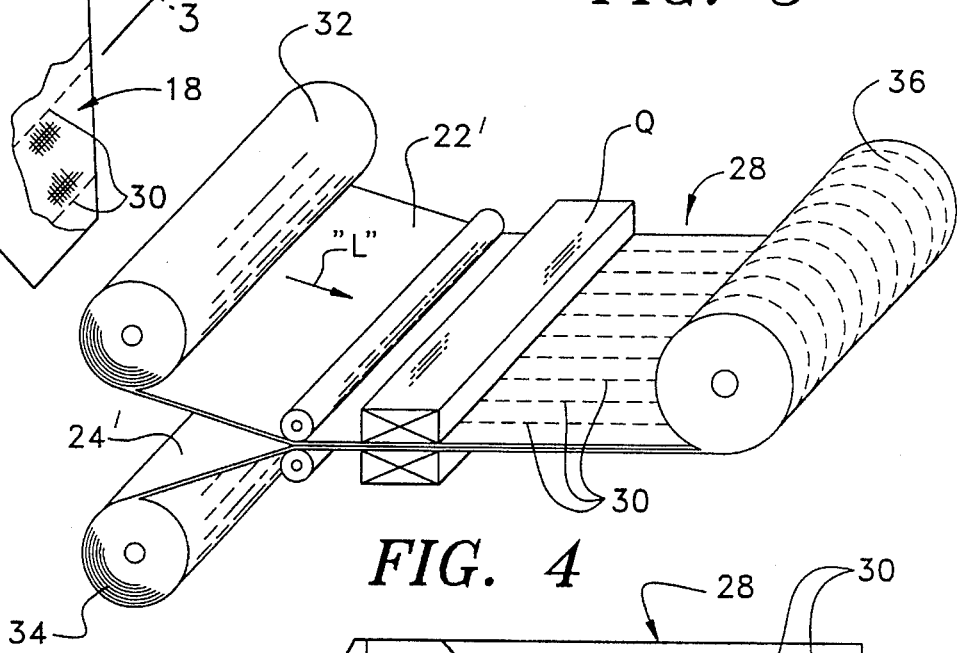
FIG. 4
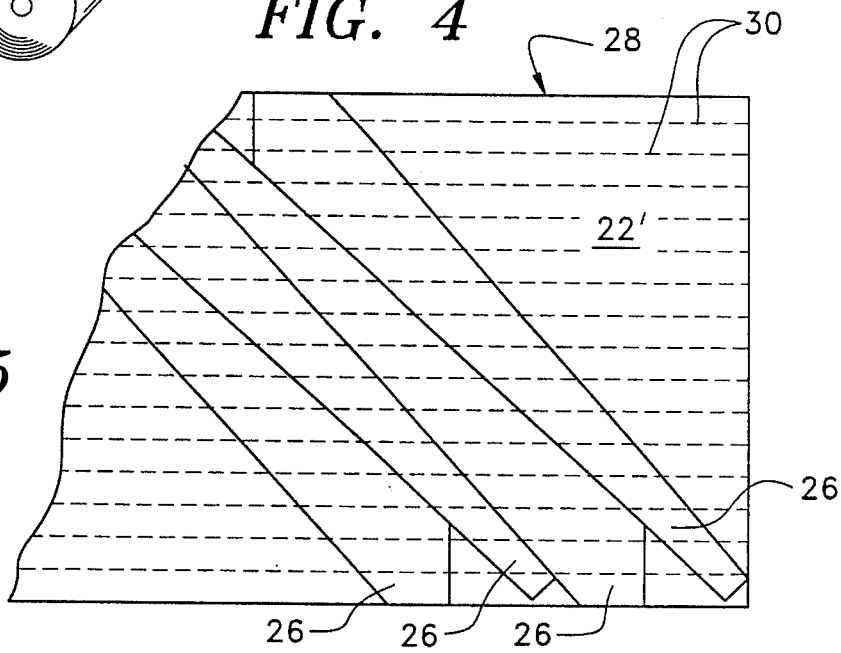
FIG. 5

MULTIPLE PLY TIE INTERLINING AND METHOD

BACKGROUND OF THE INVENTION

This invention relates to multiple ply interlinings, primarily intended for use in neckties and the like, and for other items of apparel whose construction is similar or analogous to neckwear. In another aspect, the invention relates to methods for making such interlinings and products. The present invention provides an interlining fabric which has all of the advantages of multi-ply construction, including the selective use of dissimilar plies, and which can be supplied to a maker of neckwear in indeterminate lengths and in the form of roll goods.

In the manufacture of various types of apparel, it is conventional practice to incorporate into the construction a stiffening insert, usually referred to as an interlining, and typically enclosed within a body or shell of fabric. Neckwear, such as conventional neckties, bow ties and the like, as well as analogous products such as cummerbunds, use interlinings.

Interlining fabrics conventionally consist of woven, knit or in some instances non-woven material. Woven interlining fabrics are desirable for their desirable characteristics of resiliency, drape and strength. Non-wovens can provide desirable fullness and resilience for some applications.

In the field of neckwear, it has been suggested that the characteristics of the finished products, specifically as to hand, drapability, stretch and knotting characteristics, can be improved by the use of multiple plies for composite interlinings. U.S. Pat. Nos. 3,426,360, issued Feb. 11, 1969, and 3,562,814, issued Feb. 16, 1971, illustrate examples.

One heretofore encountered disadvantage of multiple ply interlinings has been the need for increased time and care in the cutting, laying-out and construction of such interlinings and products made from them, as well as difficulty in accurately and efficiently joining such interlinings to the tie casing. One particular problem attendant the use of multiple ply interlinings has been sliding of the plies relative to each other during manufacture, prior to stitching of the interlining to the casing. The resulting mis-registry of the plies results in poor or uneven drape of the finished article, and unacceptable knotting characteristics or durability. A proposed solution to these perceived difficulties was offered in U.S. Pat. No. 4,229,834, issued Oct. 28, 1980. That patent suggested the use of a double-layer interlining fabric, constructed using a double-shed weaving technique to form two plies of cloth, the plies being interconnected by binder yarns woven together with the respective plies. In such an arrangement, the multiple ply interlining fabric can be provided to the maker of the finished product as roll goods, to be cut into individual tie linings at the time of manufacture. The two plies, however, are the same, and, because the fabric is produced on a loom, the economies of the weaving process dictate that long processing runs be used. Moreover, the relative frequency of the binder yarns, again, dictated by the weaving process, tends to yield a relatively "stiff" or "tight" interlining.

SUMMARY OF THE INVENTION

With the above as background, it is a general object of the present invention to provide a process for making a multiple ply interlining fabric, characterized by desirable attributes of drapability and stretch, but capable of being economically produced in production runs of non-specific lengths. Further, it is an object of this invention to provide an interlining fabric which can be supplied to the fabricator of neckwear in the form of roll goods, thus enabling the manufacturer to perform the cutting of interlinings and the sewing of the final products on-site without concern for the alignment of the plies of the interlining fabric. A further object of the invention to provide for interlinings using dissimilar materials, enabling the characteristics of the materials to be closely tailored to the needs of a particular user. The present invention, unlike the known prior art, allows interlinings using dissimilar materials to be delivered in the form of roll goods.

In one of its aspects, the present invention relates to an interlining of double-ply fabric, comprising a first ply and a second ply, the plies being stitched together at spaced intervals. Within the contemplation of the invention, the plies may have characteristics of weight, construction and hand which differ from each other. Stitching of the plies may be accomplished by conventional techniques, such as full width quilting.

In its method aspect, the invention contemplates steps of selecting a first ply of interlining fabric having desired properties; selecting a second ply of interlining fabric, which may have properties different from the first ply; superimposing the plies one above the other; joining the plies at spaced selected intervals to form a double ply fabric; and storing the double ply fabric as roll goods for eventual cutting and sewing of finished products.

In performing the method, the roll goods may be cut, by die-cutting or other techniques, to form individual blanks for interlinings, and the interlinings then incorporated into neckties or the like.

The present invention provides an interlining which is durable and economical to use and affords great versatility in meeting the specifications and needs of particular manufacturers. Further, interlinings in accordance with the present invention may be incorporated into necktie constructions as readily as conventional interlinings.

For the purpose of illustrating the invention, there is shown in the drawings a form of the invention which is presently preferred. It should be understood, however, that the invention is not limited to the precise arrangements and instrumentalities shown.

BRIEF DESCRIPTION OF THE DRAWINGS

FIG. 1 is a perspective view, partly broken away, of a necktie made using a multiple ply interlining in accordance with the invention.

FIG. 2 is a transverse cross-sectional view, taken along 2—2 in FIG. 1.

FIG. 3 is a transverse cross-sectional view, taken along the line 3—3 in FIG. 1, and on a scale somewhat larger than that of FIG. 2.

FIG. 4 is a schematic view, depicting a process by which a multiple ply interlining fabric is made in accordance with the invention.

FIG. 5 depicts schematically the cutting of individual tie interlinings from interlining fabric of the kind depicted in FIG. 4.

DETAILED DESCRIPTION

Referring now to the drawings in detail, in which like reference numerals indicate like elements, there is seen in FIG. 1 a necktie, designated generally by the reference numeral 10. The illustrated necktie 10 is of conventional shape and appearance, and comprises, as is seen in FIGS. 2 and 3, an outer casing 12 of decorative fabric. The casing 12 has, as is seen, an outer surface 14 and an inner surface 16.

Referring now to FIG. 2, disposed within the casing 12 of the necktie 10 is an interlining designated generally by the reference numeral 18. Conventionally, in constructing a necktie, the interlining 18 is stitched, as at 20, to the inside of the casing 12, and the casing 12 and interlining 18 are then turned to position the interlining 18 within the casing 12 as depicted in FIGS. 2 and 3. The casing 12 may then be pressed or finish stitched to form a finished necktie.

Referring again to FIGS. 2 and 3, the interlining 18 in accordance with the invention is made up of multiple plies. For example, the interlining 18 is made up of respective plies 22 and 24, the upper ply in each Figure being the ply 22 and the lower ply has the ply 24.

The interlining 18 may, in accordance with the invention, be die cut or otherwise separated as blanks 26, as seen in FIG. 5, from a sheet of roll goods designated generally by the reference numeral 28.

Referring again to FIG. 3, it can be seen that the plies 22 and 24 are positioned one above the other, and interconnected, as is seen also in FIG. 1, by spaced parallel lines of stitching 30, directed on a bias with respect to the longitudinal axis the lengthwise dimension of the tie interlining 18. Preferably, the lines of stitching 30 are spaced from each other by a distance of three inches, although other spacings may be used.

Referring now to FIGS. 4 and 5, there is seen, diagrammatically, a process by which the interlining 18 and blanks 26 may be made. As is seen in FIG. 4, a supply roll 32 provides material 22' which in the illustrated form of the invention ultimately becomes the upper ply 22 of a finished blank 26. A supply roll 34 provides material 24', which in the finished blank becomes the lower ply 24. The material 22' and 24' is sewn together by the above-mentioned stitching 30, in the direction of (that is, generally parallel to) the running length of the material 22' and 24'. The stitching 30 is preferably spaced at about three inch intervals across the full width of the material 22' and 24'. The web of double-ply material created by the sewing together of the material 22' and 24' is taken up on a roll 36, and can then be shipped to a customer as the roll goods 28, for use in the cutting and sewing of blanks 26.

In the presently preferred process, the sewing together of the material 22' and 24' is performed on a conventional full width quilting machine "Q", set to provide the desired three inch spacing, straight stitched. The result of such an operation is the simultaneous creation of parallel rows of stitching 30 across the full width of the material 22' and 24'. Other equivalent stitching techniques may be used.

A three inch spacing, with straight stitching, has been found to provide a somewhat loose association of the respective plies, imparting to the resulting multiple ply material desirable characteristics of drape and hand while interconnecting the plies 22' and 24' sufficiently securely to enable their handling in the cutting, sewing and reversing operations needed to provide finished products such as neckwear. It will be understood that other spacings may be used, generally within a range of about one and one half (1½) to six (6) inches.

As is seen in FIG. 5, blanks 26 for tie linings are preferably cut on a bias of approximately 45 degrees with respect to the longitudinal (running length) of the roll goods 28, and consequently, the stitching 30 is also disposed on a bias with respect to the lengths of the blanks 26. This feature tends to minimize any unwanted "directional" characteristics of the multiple ply interlining fabric and to yield desirable characteristics of drape and stretch. The above-described technique does not unduly stiffen the interlining 18, as has been a shortcoming of double-woven tie interlinings of the prior art.

In FIG. 5, blanks 26 are shown as cut by a double gang die, oriented at approximately 45 degrees with respect to the direction of the running length. The width of the roll goods is preferably about 38 inches, so that the blanks 26 traverse substantially the full width of the material.

As is seen in FIGS. 4 and 5, the stitching 30 may be arranged so that no line of stitching is made at or near the edge of the web of multiple ply material (the roll goods 28).

The economics of the present process are such that short production runs are feasible and dissimilar materials can readily be used for the respective plies 22 and 24. Indeed, the present invention affords to designers and manufacturers of neckwear the possibility of combining in an economical way the attributes of different interlining fabrics. For example, a ply of fabric made from a blend of wool and fibers of polyester, viscose and acrylic may be joined with a ply of fabric made entirely of synthetic fibers, such as polyester, acrylic, or viscose (or blends of them) to achieve a hand, bulk and crease resistance desirable for a given application. Cotton/synthetic blends, as well as certain nonwoven fabrics may also be used in combination with other suitable fabrics.

The present invention may be embodied in other specific forms without departing from its spirit or essential attributes. Accordingly, reference should be made to the appended claims, rather than the foregoing specification, as indicating the scope of the invention.

I claim:

1. A method for making neckwear, comprising the steps of selecting a first ply of interlining fabric having desired mechanical properties, selecting a second ply of interlining fabric having desired mechanical properties, superimposing said plies one above the other, joining said plies by stitching therethrough to form a multiple ply fabric having composite properties, collecting the multiple ply fabric as roll goods having a running length, cutting the roll goods to form individual tie linings having respective lengths and widths, and forming around said tie linings a fabric casing.

2. A method in accordance with claim 1, wherein said steps of selecting a first and a second ply are so performed as to provide first and second plies having different mechanical properties, so that the step of joining the plies provides in the multiple ply fabric desirable composite properties.

3. A method in accordance with claim 2, wherein the step of stitching is so performed as to create spaced parallel lines of stitching in the direction of the running length of the roll goods.

4. A method in accordance with claim 3, wherein the step of stitching is so performed as to space the lines of stitching by about three inches.

5. A method in accordance with claim 3, wherein the step of cutting the roll goods is so performed that the lines of stitching are oriented on a bias with respect to the lengths of the tie linings.

6. A method in accordance with claim 5, wherein the step of stitching is so performed as to space the lines of stitching by about three inches.

7. A method in accordance with claim 6, wherein said step of stitching is performed by a quilting machine.

8. A method for making an interlining fabric, useful for use in neckwear, comprising the steps of selecting a first ply of interlining fabric having properties of construction, weight and hand suitable for use in neckwear, selecting a second ply of interlining fabric having properties of construction, weight and hand suitable for use in neckwear, superimposing said plies one above the other in a web having a running length, joining said plies to form a multiple ply fabric having composite properties, and collecting the multiple ply fabric as roll goods so that individual tie interlining blanks can be cut from the fabric, said step of joining said plies being performed by stitching therethrough.

9. A method in accordance with claim 8, wherein the step of stitching is performed by a quilting machine, the stitching being along the length of the web.

10. A method in accordance with claim 9, wherein the stitching along the length of the web is spaced in the transverse direction of the web by a distance of between one and one-half and six inches.

11. A method in accordance with claim 10, wherein the stitching is spaced in the transverse direction of the web by a distance of about three inches.

12. An interlining fabric, for neckwear, comprising a first ply of interlining fabric having properties of construction, weight and hand suitable for use in neckwear, a second ply of interlining fabric having properties of construction, weight and hand suitable for use in neckwear, said first and second plies being superimposed in running lengths so as to facilitate shipment and storage of the fabric as roll goods, and stitching joining said first and second plies at spaced intervals, said stitching being oriented in lines extending generally parallel to the direction of the running lengths of said plies, whereby elongated individual tie interlining blanks can be cut from the fabric with the stitching oriented on a bias with respect to the lengths of the blanks.

13. An interlining fabric in accordance with claim 12, wherein said first and second plies have different mechanical properties.

14. An interlining fabric in accordance with claim 13, wherein said stitching comprises parallel lines of stitching spaced from one another in the direction of the running lengths of said plies.

15. An interlining fabric in accordance with claim 14, wherein said lines of stitching are spaced by a distance of between one and one-half and six inches.

16. An interlining fabric in accordance with claim 15, wherein said lines of stitching are spaced by a distance of about three inches.

* * * * *